United States Patent [19]

Tomlinson

[11] Patent Number: 4,610,545

[45] Date of Patent: Sep. 9, 1986

[54] MIXER

[75] Inventor: Robert K. Tomlinson, Woodville, Australia

[73] Assignee: Monier Limited, Woodville, Australia

[21] Appl. No.: 626,699

[22] Filed: Jul. 2, 1984

[30] Foreign Application Priority Data

Jul. 5, 1983 [AU] Australia ..... PG0135

[51] Int. Cl.[4] ..... B28C 5/00

[52] U.S. Cl. ..... 366/2; 198/622; 241/200; 366/53; 366/64; 366/271

[58] Field of Search ..... 366/1, 2, 27–30, 366/41, 42, 49, 53, 64, 109, 186, 348, 349; 198/622; 241/200

[56] References Cited

U.S. PATENT DOCUMENTS

| | | | |
|---|---|---|---|
| 2,152,939 | 4/1939 | Wentworth | 198/622 |
| 2,663,228 | 12/1953 | Serpas | 241/200 |
| 4,060,167 | 11/1977 | Smith | 366/271 |
| 4,324,495 | 4/1982 | Martinez | 366/271 |

*Primary Examiner*—Timothy F. Simone
*Attorney, Agent, or Firm*—Jay L. Chaskin

[57] ABSTRACT

A concrete mixer in this invention comprises an elastomeric lug belt carried by a first set of roller drums at least one of which is driven, the lug belt having a plurality of spaced elastomeric lugs thereon, and an elastomeric base belt carried by a second set of roller drums and depending between two of these roller drums to form a part-loop portion, at least one of the base belt roller drums also being driven to drive the lug belt past the base belt in a mixing zone in the part-loop portion, such that the base belt moves in the opposite direction from the direction of movement of the lug belt.

27 Claims, 10 Drawing Figures

MIXER

This invention relates to a concrete mixer, and is particularly applicable to a continuous mixer, although the invention can also be used in mixers for intermittent duty. The invention also relates to a method of mixing concrete.

BACKGROUND OF THE INVENTION

One of the problems which is encountered with concrete mixers, particularly of the so-called "turbine" type, is the difficulty of maintaining the lugs or blades clean, since concrete tends to pack between the lugs and the supporting surfaces. This difficulty is most noticeable when the concrete is of the "dry mix" type, and commonly a mixer requires cleaning twice a day. Until such time as it is cleaned, the mixer gets less and less efficient. The cleaning however is a time consuming unpleasant and expensive operation.

Another problem which is encountered is that there is a high wear rate on the ends of metal lugs or blades, and relatively low through-put in many cases.

Another problem which is encountered is that turbine mixers absorb very large amounts of power, and for example a mixer of sufficient size to have a through-put of 800 kg per minute can absorb as much as 60 h.p.

Even more important than the abovementioned difficulties however is the difficulty that many mixers have in mixing some dry mixes without segregation or without aeration. When the concrete is poured, extruded or pressed, quite often the air is not released sufficiently to ensure that the resultant product has maximum density, and there is a consequential loss of mechanical strength. This difficulty is a major difficulty with concrete having only a small water content, and it is a difficulty which has not been completely solved with previous machines.

One object of this invention is to provide a method of mixing the ingredients of Portland cement based concrete, and to provide a mixer which is capable of mixing concrete by that method, whereby the above-mentioned problems can all be reduced to some extent at least.

BRIEF SUMMARY OF THE INVENTION

The method in this invention comprises mixing the concrete ingredients between a lug belt having a series of outstanding transversely oriented elastomeric lugs thereon and moving in one direction, and the surface of an elastomeric base belt moving in the opposite direction, in a concave (or catenary) mixing zone, while at the same time traversing the mixed concrete across the mixing zone with respect to the direction of belt travel, by impingment of the transversely oriented lugs.

Speed and through-put can be adjusted so that the lugs initially roll the concrete with respect to the elastomeric belt, and the lugs can be oriented alternatively in a left and right hand direction, but more in one direction than the other so that the concrete is traversed between the moving belt and the moving lugs transversely of the direction of travel of belt and lugs.

A concrete mixer in this invention comprises an elastomeric lug belt carried by a first set of roller drums at least one of which is driven, the lug belt having a plurality of spaced elastomeric lugs thereon, and an elastomeric base belt carried by a second set of roller drums and depending between two of these roller drums to form a part-loop portion, at least one of the base belt roller drums also being driven to drive the lug belt past the base belt in a mixing zone in the part-loop portion, such that the base belt moves in the opposite direction from the direction of movement of the lug belt.

With this invention, it is found that the horsepower requirement is very much less and for example for a through-put of 8000 kg per minute, less than 12 h.p. is required to drive the equipment under normal operating conditions. Furthermore, the use of an elastomer for both the lug and base belts, and for the lugs themselves, results in a self-cleaning action due to continuous flexure of the lugs and belts, which greatly reduces maintenance requirements. The efficiency of the mixer is such that the mixer can be physically smaller and therefore less expensive. The mixer can be used for continuous or intermittent mixing and has the capability of a turn down ratio in output capacity of 4:1 by slowing the two contra rotating belts.

In prior art, the reader's attention is drawn to U.S. Pat. Nos. 4,060,167 (Smith) and 4,324,495 (Martinez), but in neither of these is there any equivalent of mixing taking place in a concave or catenary of an elastomeric belt.

BRIEF DESCRIPTION OF THE DRAWINGS

It will immediately be clear that many embodiments of the invention are available, and in the accompanying drawings several embodiments are illustrated.

Figure 1:
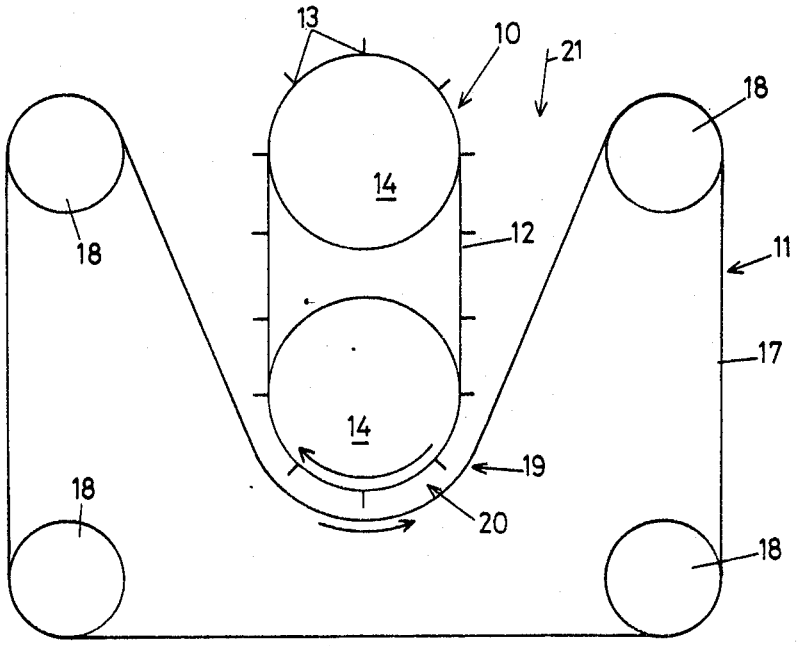
FIG. 1 is a diagrammatic end elevation of a concrete mixer according to a first embodiment.

In each of the described embodiments herein, there is provided a lug belt assembly 10 and a base belt assembly 11, in each instance the lug belt assembly 10 comprising a lug belt 12 of elastomeric material, which has outstanding elastomeric lugs 13 projecting therefrom in horizontal rows. Each lug belt is carried on roller drums 14, at least one of which is movable towards the other so that the lug belt 12 can be quickly and easily removed. One of the roller drums 14 is motorised for effecting its rotation. Although cleaning is seldom required, easy removal of the lug belt 12 from its roller drums facilitates any cleaning that is required.

Figure 3:
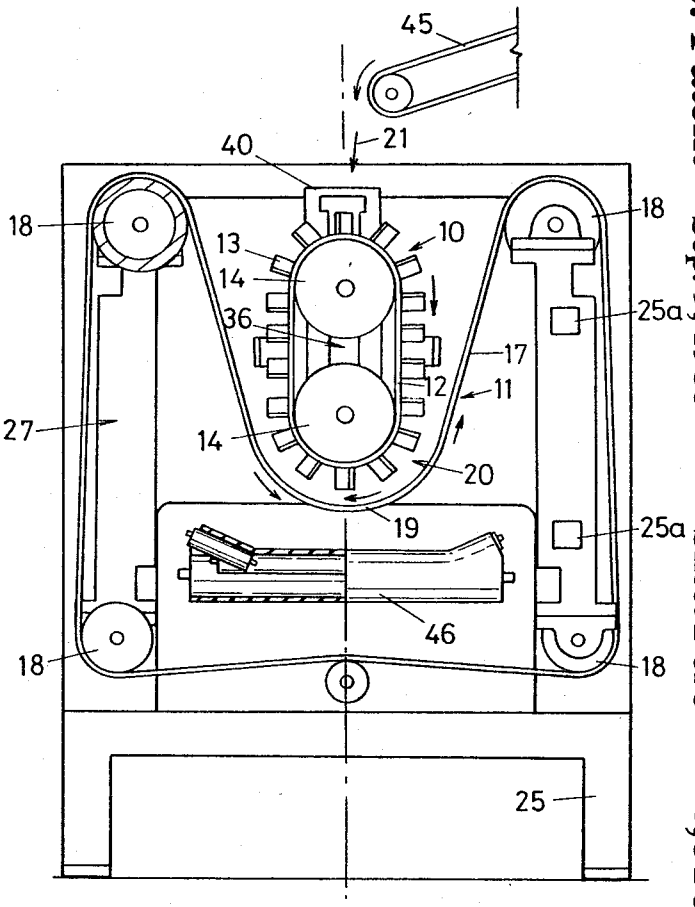
FIG. 3 is a partly sectioned end elevation of FIG. 2.
Figure 4:
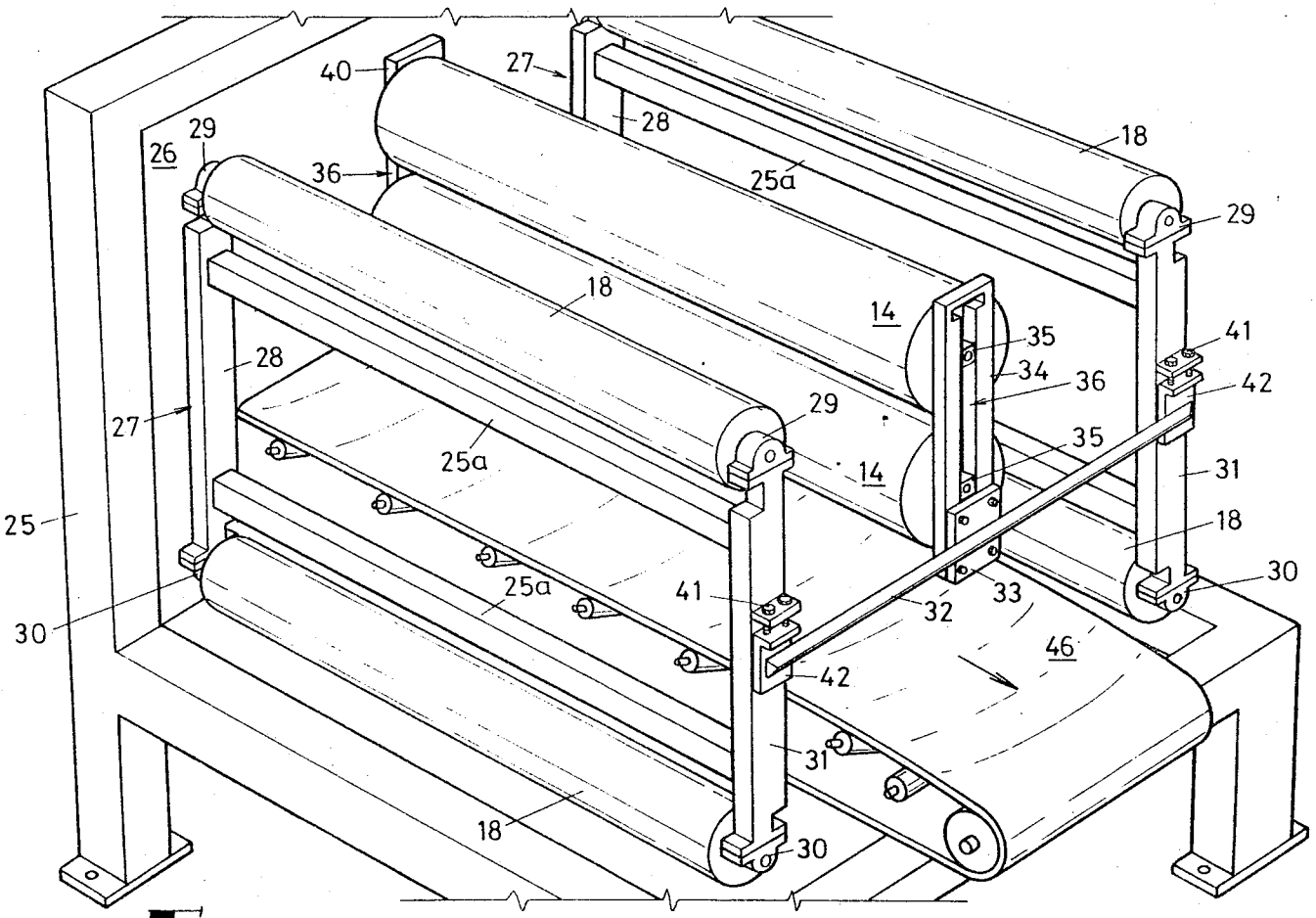
FIG. 4 is a fragmentary perspective view illustrating the arrangement of the roller drums which carry the belts.
Figure 5:
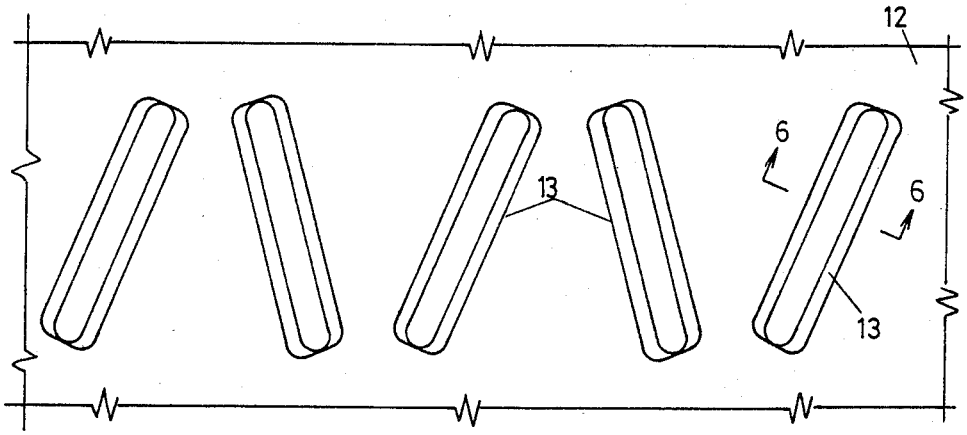
FIG. 5 shows the belt lug layout to an enlarged scale.
Figure 6:
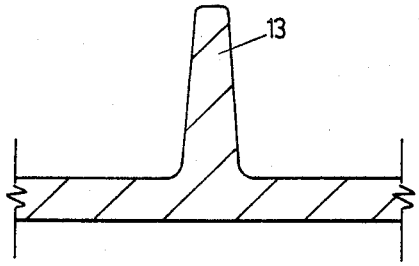
FIG. 6 is a section through a belt lug taken on line 6—6 of FIG. 5.
Figure 7:
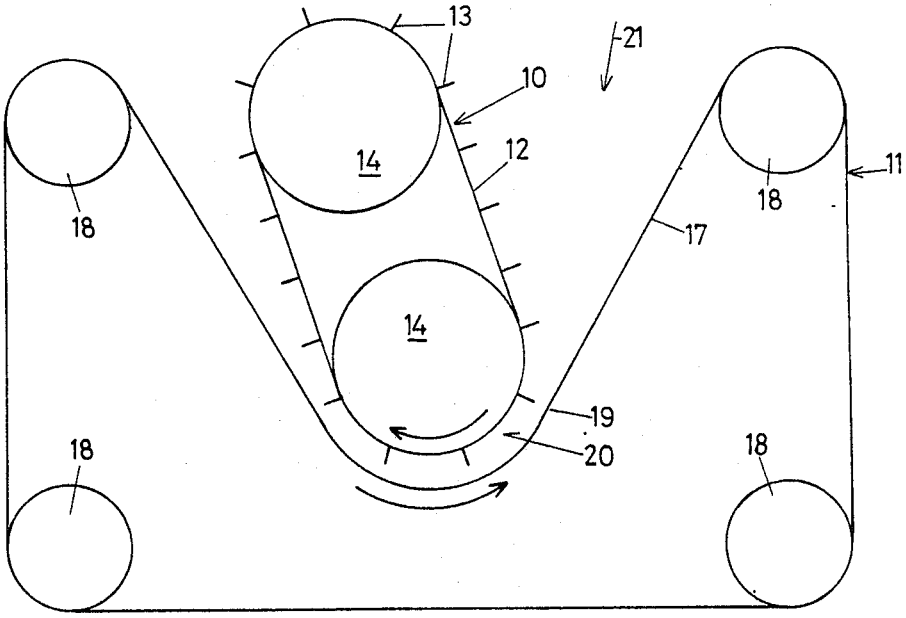
FIG. 7 is an end elevation according to a second embodiment.
Figure 8:
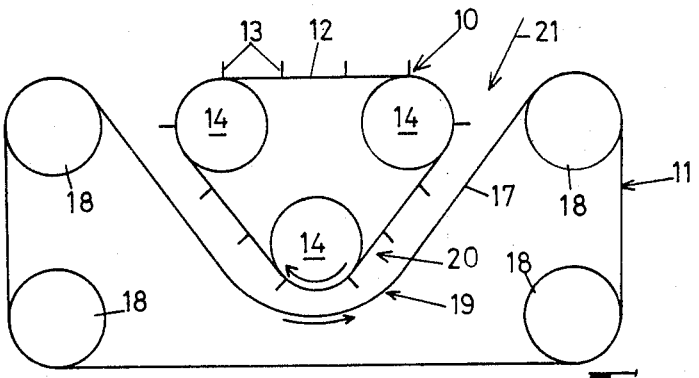
FIG. 8 is an end elevation according to a third embodiment.

Each base belt assembly 11 comprises a base belt 17, and in the embodiments of FIGS. 1 to 9, the base belt 17 is carried on the base belt roller drums 18. The drums 18 are both motorised to effect simultaneous drive, the belt 17 being of such length that it depends from the upper roller drums 18 and forms a depending catenary or part-loop portion 19 which is concave and defines, with the lower-most traverse of the lug belt 12, a mixing zone 20. In each instance, there are provided end plates (not shown) for retaining the belts in position on their roller drums. In each case also it will be noted that the direction of traverse of the lug belt 12 through the mixing zone 20 is opposite the direction of travel of the base belt 17, and the lug belt 12 is driven at a faster peripheral speed than the base belt so that material which is charged as shown by arrow 21 is urged downwardly by lugs 13 into the mixing zone 20, but urged back by the base belt 17 in the opposite direction. Speed and through-put is so selected that the concrete after having been mixed is discharged before it is lifted away from the base belt 17 during the upward traverse of the lugs 13. Alternate lugs 13 in each horizontal row are transversely oriented both to left and to right, but as shown in FIG. 5, more in one direction than the other so that during the mixing operation concrete charged as shown by arrow 21 will be impinged by the transversely oriented lugs and thereby be discharged either at the front of the mixer, or, as shown, at both ends.

Figure 2:
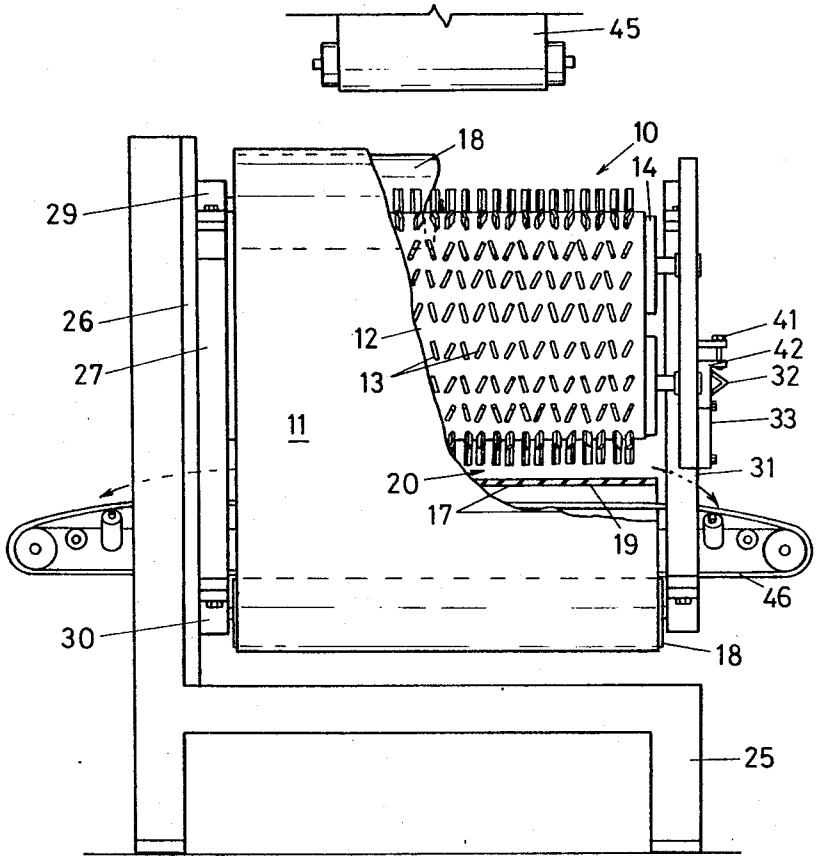
FIG. 2 is a side elevation of the concrete mixer of FIG. 1 showing constructional details.

Referring more particularly to the details illustrated in FIGS. 2, 3 and 4, there is provided an L-shaped main frame 25, the vertical portion of which carries a mounting plate 26 to which are secured a pair of drum support frames 27, each drum support frame 27 comprising a pair of bearing posts 28 which carry rear upper and lower bearings 29 and 30 which support the rear ends of the upper and lower rollers 18, each support frame 25 also having a pair of forwardly projecting rails 25*a* which extend to front bearing posts 31 which similarly carry corresponding front bearings 29 and 30 for supporting the front ends of upper and lower roller drums 18 respectively.

A transverse bar 32 extends across the mixer between the front bearing posts 31 and carries on it a mounting plate 33 which mounts a front bearing guide 34 which carries the front bearings 35 for the vertically spaced roller drums 14 of the lug belt assembly 10, the bearings being movable and adjustable within a slot 36 so that the rollers can be moved towards or away from one another. The mounting plate 26 carries a similar rear bearing guide 40 also having in it a slot 36. The adjustment and clamping means for the bearings 35 (and their corresponding rear bearings) are not herein illustrated. There are provided adjustment screws 41 carried on respective bearing posts 31 and coupled through mounting brackets 42 to the transverse bar 32 for adjusting the height of the roller drums 14 with respect to the catenary half-loop portion 19 in the base belt 17.

An input conveyor 45 introduces blended concrete ingredients into the mixer and this is moved downwardly into the mixing zone 20 by the lug belt 12, where it is caused to move in a rolling action between the two belts and at the same time is moved back and forth, and in the embodiments shown is discharged at each end of the mixing zone 20 onto a discharge conveyor 46. In some embodiments the lug belt 12 moves upwardly through the mixing zone 20.

Figure 9:
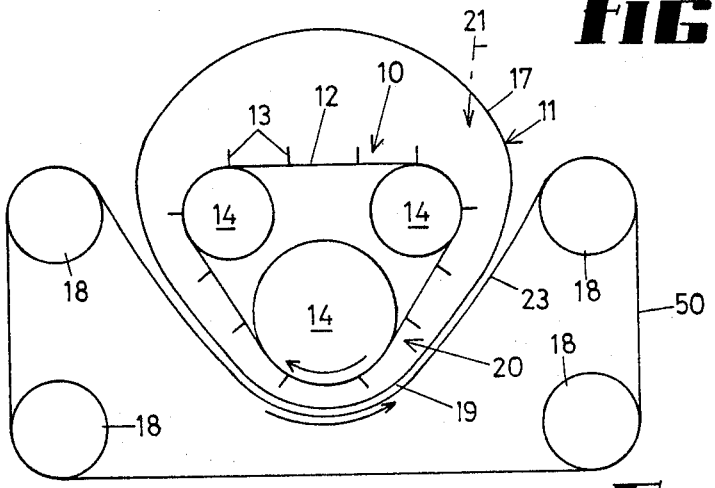
FIG. 9 is an end elevation according to a fourth embodiment.
Figure 10:
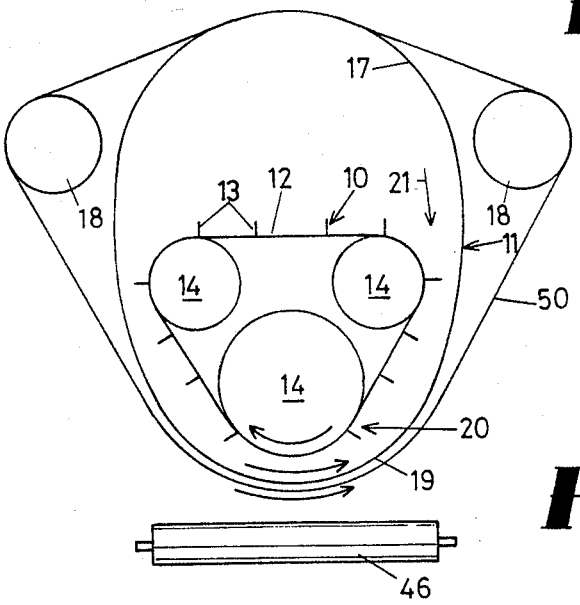
FIG. 10 is an end elevation according to a fifth embodiment.

In FIGS. 1 through to 8, it will be seen that the base belt 17 is always wet, and this passes over the pulleys 18. In some instances however it is desired to avoid the possibility of concrete adhering to the roller drums 18, and in FIGS. 9 and 10 the base belt 17 is in the form of a continuous loop which is carried by a belt carrier 50, driven by the pulleys 18. The width of the carrier 23 is less than the width of the base belt 17 which it supports, thereby reducing likelihood of concrete spillage onto the belt carrier 50, and consequential carrying of the concrete onto the surfaces of the roller drums 18. As shown in FIG. 10, both concrete and spillage discharges onto a conveyor 46 which will convey the mixed concrete away from the mixer.

In the described embodiments of the invention there is provided a pre-mix stage which discharges into the mixer, premixing the dry ingredients of the concrete, but this is not always essential.

A brief consideration of the above embodiment will indicate that the invention is very simple. It will also indicate that the invention can be made, because of its high efficiency, to a small size for intermittent or batch mixing. Furthermore, it will be appreciated that the arrangements of FIG. 9 or 10 are suitable for containing a mix during travel of a vehicle from a loading station to a site. This avoids much of the difficulty which is presently encountered with mixers which utilise steel blades, which can cause aeration of the mix, and which require frequent cleaning.

Various modifications in structure and/or functions and/or steps can be made to the disclosed embodiments by one skilled in the art without departing from the scope of the invention as defined by the claims.

I claim:

1. A method of mixing concrete comprising the steps of;

providing a lug belt having elastomeric lugs outstanding from one surface thereof and oriented more in one transverse direction than the other, the belt being carried on horizontal roller drums;

providing a base belt carried by other horizontal drums and freely depending between two of those other roller drums to form a catenary portion extending below the other horizontal drums;

disposing the lug belt into the catenary portion of the base belt to form a mixing zone between the lug belt and the base belt;

introducing concrete ingredients into the mixing zone formed between said catenary portion and said lug belt;

and driving at least some of the roller drums to cause the belts to move in opposite directions, while at the same time traversing the mixed concrete ingredients across the mixing zone with respect to the direction of belt travel, by impingement of the transversely oriented lugs on the concrete ingredients.

2. A method of mixing concrete according to claim 1 comprising moving said lug belt downwardly in the mixing zone while moving said base belt upwardly.

3. A method according to claim 2 comprising moving the lug belt at a faster speed than the base belt.

4. A method according to claim 2 further comprising discharging blended concrete ingredients into said mixing zone by discharging thereinto from an input conveyor.

5. A method of mixing concrete according to claim 1 comprising moving said lug belt upwardly in the mixing zone while moving said base belt downwardly.

6. A method of mixing concrete according to claim 1 comprising moving the lug belt at a faster speed than the base belt.

7. A method of mixing concrete according to claim 1 further comprising discharging blended concrete ingredients into said mixing zone by discharging thereinto from an input conveyor.

8. A method of mixing concrete according to claim 1 comprising discharging the concrete, after mixing in the mixing zone, over an edge of the base belt onto a discharge conveyor.

9. A method according to claim 1 comprising carrying the base belt on a belt carrier and causing the roller drums to move the belt carrier.

10. A method of mixing according to claim 1 comprising moving one of the belts at a faster speed than the other belt.

11. A concrete mixer comprising a main frame, a first set of roller drums carried by the frame and journalled for rotation with respect thereof, drive means coupled to at least one of said first set of roller drums for rotational driving thereof, a lug belt carried by said first set of roller drums, and a plurality of spaced outstanding transversely oriented elastomeric lugs outstanding from said lug belt, a second set of roller drums also carried by the frame and journalled for rotation with respect thereto, further drive means coupled to at least one of said second set of roller drums for rotational driving thereof, and a base belt of elastomeric material carried by said second set of roller drums and being of such length that portion thereof depends between two of the roller drums of said second set and forms a concave catenary portion of the base belt with respect to the roller drums of the second set, the lug belt being disposed into the catenary portion and spaced therefrom.

12. A concrete mixer according to claim 11 further comprising a pair of parallel spaced drum support frames carried by the frame, and each having upper and lower bearings journalling the ends of respective roller drums of said second set thereof for rotation, said base belt depending from the upper of said roller drums to form said concave depending part-loop portion.

13. A concrete mixer according to claim 12 wherein each said drum support frame comprises front and rear bearing posts each supporting a said upper bearing and lower bearing, further comprising a transverse bar bridging said front bearing posts, mounting means on the bar supporting a front bearing guide, a rear bearing guide carried on the main frame, a slot extending vertically in each respective said bearing guide and upper and lower bearings adjustable for position in each said slot, said adjustable bearings journalling the ends of respective roller drums of said first set thereof for rotation.

14. A concrete mixer according to claim 13 wherein the drum support frame includes means for adjusting the height of the first set of roller drums with respect to the catenary portion.

15. A concrete mixer according to claim 12 wherein the drum support frame includes means for adjusting the height of the first set of roller drums with respect to catenary portion.

16. A concrete mixer according to claim 12 wherein said elastomeric lugs are arranged in rows across said lug belt, and alternate said elastomeric lugs of each row are transversely oriented in opposite directions and by different amounts.

17. A concrete mixer according to claim 12 further comprising an input conveyor terminating above the mixing zone and arranged to discharge concrete ingredients into the mixing zone, and a discharge conveyor below the mixing zone and extending outwardly beyond the belts for discharging concrete mixed in the mixing zone.

18. A concrete mixer according to claim 11 wherein said elastomeric lugs are arranged in rows across said lug belt, and alternate said elastomeric lugs of each row are transversely oriented in opposite directions and by different amounts.

19. A concrete mixer according to claim 11 further comprising an input conveyor terminating above the mixing zone and arranged to discharge concrete ingredients into the mixing zone, and a discharge conveyor below the mixing zone and extending outwardly beyond the belts for discharging concrete mixed in the mixing zone.

20. A concrete mixer according to claim 11 wherein the base belt is carried by a belt carrier, the second set of roller drums driving the belt carrier.

21. A method of mixing wherein a belt having a plurality of lugs extends between roller drums and a base belt extends between other roller drums comprising the steps of:

causing the base belt to have a portion thereof to freely depend between the other roller drums to provide a catenary belt portion extending below the other roller drums;

depending the lug belt into the catenary belt portion and spaced from the base belt to form a mixing zone between the depending catenary portion and the lug belt;

introducing material to be mixed into the mixing zone;

allowing the lug belt to traverse the mixing zone whereby the lugs penetrate the material in the mixing zone; and driving at least some of the roller drums to cause the belts to move in opposite directions at the location of the mixing zone.

22. A method of mixing according to claim 21 comprising moving the lug belt downwardly in the mixing zone while moving the base belt upwardly.

23. A method of mixing according to claim 21 comprising moving the lug belt upwardly in the mixing zone while moving the base belt downwardly.

24. A method of mixing according to claim 21 comprising moving the lug belt at a faster speed than the base belt.

25. A method of mixing according to claim 21 comprising moving one of the belts at a faster speed than the other belt.

26. A method of mixing according to claim 21 comprising discharging material into the mixing zone by discharging thereinto from an input conveyor.

27. A method of mixing according to claim 21 comprising discharging the material, after mixing in the mixing zone, over an edge of the base belt onto a discharge conveyor.

* * * * *